United States Patent [19]

Wirland

[11] Patent Number: 4,718,132

[45] Date of Patent: Jan. 12, 1988

[54] PIECE OF FURNITURE, SUCH AS A PIECE OF SEATING OR REST FURNITURE

[75] Inventor: Kurt Wirland, Älmhult, Sweden

[73] Assignee: Inter-Ikea A/S, Humlebæk, Denmark

[21] Appl. No.: 873,716

[22] Filed: Jun. 12, 1986

[51] Int. Cl.[4] ..... A47C 19/02

[52] U.S. Cl. ..... 5/11; 5/238; 5/207; 5/209; 5/400; 108/152

[58] Field of Search ..... 5/11, 411, 412, 207, 5/208, 209, 400, 285, 201, 238, 200 R; 403/399, 232.1; 312/245; 108/152; 248/903, 489, 544

[56] References Cited

U.S. PATENT DOCUMENTS

| | | | |
|---|---|---|---|
| 275,202 | 4/1883 | Hammerschmidt | 5/238 |
| 461,687 | 10/1891 | McMaster | 5/238 |
| 522,829 | 7/1894 | Goetz | 5/238 |
| 726,046 | 4/1903 | Grabs | 5/238 |
| 1,057,719 | 4/1913 | Farnsworth | 5/286 |
| 1,093,542 | 4/1914 | Crissman | 5/238 |
| 1,537,834 | 5/1925 | Lally | 403/232.1 |
| 2,018,529 | 10/1935 | Parrish | 5/209 |
| 2,492,070 | 12/1949 | Stone et al. | 5/238 |
| 2,601,685 | 7/1952 | Womack | 5/308 |
| 2,686,322 | 8/1954 | Blanke | 5/282 R |
| 2,700,584 | 1/1955 | Hobbj | 5/238 |
| 3,129,439 | 4/1964 | Michal | 5/207 |
| 4,051,789 | 10/1977 | Howitt | 108/152 |
| 4,291,996 | 9/1981 | Gilb | 403/232.1 |
| 4,573,226 | 3/1986 | Wittmann | 5/236 R |

FOREIGN PATENT DOCUMENTS

| | | | |
|---|---|---|---|
| 24699 | 2/1883 | Fed. Rep. of Germany | 5/238 |
| 3230494 | 2/1984 | Fed. Rep. of Germany | 5/236 R |
| 432870 | 4/1984 | Sweden | 5/238 |

*Primary Examiner*—Alexander Grosz
*Assistant Examiner*—Eric K. Nicholson

[57] ABSTRACT

In a piece of furniture, such as a piece of seating or rest furniture of the type comprising a substantially rectangular frame having two opposing frame sidepieces, a plurality of parallel, longitudinally extending grooves is provided on opposing surfaces of said sidepieces. A first flange extending in the longitudinal direction of the profiled rail member is insertable into the grove to support a bottom portion in the furniture. The rail member further comprises a web, which abuts the frame sidepiece, when the first flange has been inserted into one of the grooves, and a secónd flange connected to the first flange and/or the web of the rail member and extending outwardly from the frame sidepiece. The first flange forms an acute angle in the range of 15°–75°, preferably 30°–60°, with the web. The grooves formed in the frame sidepieces are correspondingly inclined and free of internal lining. As a result a very simple and inexpensive piece of furniture is obtained. The construction further allows a reliable adjustment in height of the bottom portion and makes it possible to maintain the profiled rail member in the frame sidepieces without using separate fastening means.

9 Claims, 4 Drawing Figures

PIECE OF FURNITURE, SUCH AS A PIECE OF SEATING OR REST FURNITURE

FIELD OF THE INVENTION

The invention relates to a piece of furniture, such as a piece of seating or rest furniture of the type comprising a substantially rectangular frame having two opposing frame sidepieces, a plurality of parallel, longitudinally extending grooves being provided on opposing surfaces of said sidepieces, a first flange extending in the longitudinal direction of a profiled rail member being insertable to support a furniture bottom portion, the rail member further comprising a web, which abuts the frame side piece, when the first flange has been inserted into one of the grooves, and a second flange connected with the first flange or the web of the rail member and extending outwardly from the frame sidepiece.

BACKGROUND ART

Swedish published specification No. 432,870 discloses a bed comprising frame sidepieces with internal grooves, in which profiled rail members are placed to support a bedforming device, the first flange of said profiled rail members being perpendicular to the web of the rail member, and the grooves in a similar manner being perpendicular to the inner side of the frame sidepiece. The rail members are screwed to the frame sidepieces. This method of fastening the rail members is not completely satisfactory, as separate fastening means in the form of screws have to be applied to ensure that the first flange remains in the groove.

A short furnishing is known from German Patent Specification No. 24,699 for connecting the sides with the end pieces of a bed. The furnishing consists of two identical furnishing parts, each mounted on an end of the two bed parts to be assembled. Each furnishing part comprises an outwardly bent end portion. The outwardly bent end portion on one furnishing part turns up, and the outwardly bent end portion on the second furnishing part turns down; the downwardly turning end portion may rest on the upwardly turning end portion. This principle of assembling does not fulfil modern requirements to quick and inexpensive manufacture of furniture, as the furnishing parts are embedded in slots in the bed parts, and the bed parts would consequently require a separate manufacturing process.

SUMMARY OF THE INVENTION

It is the object of the present invention to provide a piece of furniture of the above type, which is simple in construction and easy to manufacture, and which allows a simple and reliable adjustment of the bottom at different levels and furthermore permits the rail members to be maintained in the frame sidepiece without using separate fastening means.

The bed according to the invention is characterized in that the first flange with the web forms an acute angle v in the range of 15°–75°, preferably 30°–60°, and that the grooves formed in the frame sidepieces are correspondingly inclined and free of internal lining. As a result the profiled rail members can in a simple manner be maintained safely in the groove without use of separate fastening means, and the groove provides optimum supporting capacity for the rail members. A too great angle will involve the risk of the rail member falling out of the groove, and a too small angle will involve the risk that the frame material at the lower edge of the groove breaks when the rail is stressed. As the groove has no internal lining the frame sidepieces are very simple to manufacture.

According to the invention the web is provided with bores for screwing the rail member onto the frame side piece. An additional security against the rail member falling out is thus achieved. This additional security can be useful, if the piece of furniture is to endure frequent removals.

Furthermore, according to the invention the depth of the groove may be greater than the length of the flange insertable into the groove, and the lower edge of the groove may be bevelled. This embodiment has the advantage that the lower surface of the flange projecting into the groove will abut the lower surface of the groove completely, and that the stress on the lower edge of the groove is minimized.

Furthermore according to the invention a strengthening mounting abutting the inner surface of the frame sidepieces may be provided at each end of the frame sidepieces, said mountings having mutually spaced slots of approximately the same width as the grooves in the frame sidepieces, the first flange of the rail member extending through said slots, whereby the web abuts the strengthening mounting, when the rail member is mounted in one of the grooves. A reinforcement of the groove at the groove ends is consequently obtained, where the greatest risk of the groove breaking down exists.

The strengthening mounting may furthermore according to the invention comprise two mounting parts perpendicular to each other; one of these mounting parts provided with slots abuts the inner surface of the frame sidepiece, and a mounting part perpendicular to said surface abuts the edge of the frame sidepiece. This embodiment has in practice proved very advantageous, as the groove at the groove ends is reinforced to the optimum extent, and it is thus rendered possible to manufacture the frame sidepieces of a comparatively inexpensive material, e.g. chip board, without the risk of the grooves breaking down when the rail members are stressed.

Further according to the invention the strengthening mounting may be of substantially the same height as the frame sidepiece, and the mounting part abutting the edge of the frame sidepiece may be of substantially the same width as said surface, and the mounting part provided with slots may be of a width in the range of 10–50 mm, preferably 12–25 mm. This embodiment has in practice turned out to be very expedient when the frame sidepieces are made of a relatively weak material.

Still further according to the invention the slots in the mountings may be dimensioned and positioned relative to the grooves in such a manner that the stress on the rail member at the rail member ends is transferred to the mounting. This involves that the lower edge of the groove is not subjected to stress, whereby the risk of the frame material breaking off when the rail member is stressed is minimized.

Finally according to the invention the rail members may be positioned at different levels to provide an inclined bottom portion and thus an inclined seating in the furniture. This embodiment enables both a change of the total seating height and a change of the seating inclination.

BRIEF DESCRIPTION OF THE DRAWING

The invention will be described below with reference to the accompanying drawing, in which.

DESCRIPTION OF THE PREFERRED EMBODIMENTS

Figure 1:
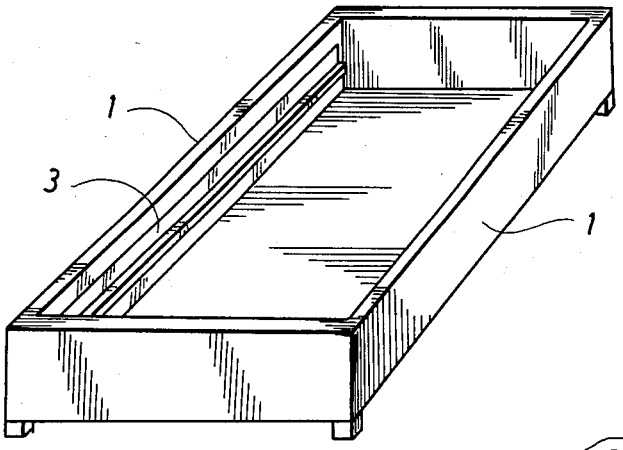
FIG. 1 is a perspective view of the piece of furniture according to the invention, formed as a bed.

FIG. 1 illustrates a piece of furniture consisting of a rectangular frame, on which a profiled rail member 3 capable of supporting a bed-forming device or bottom portion is provided on each inner side of two opposing frame sidepieces 1.

Figure 2:
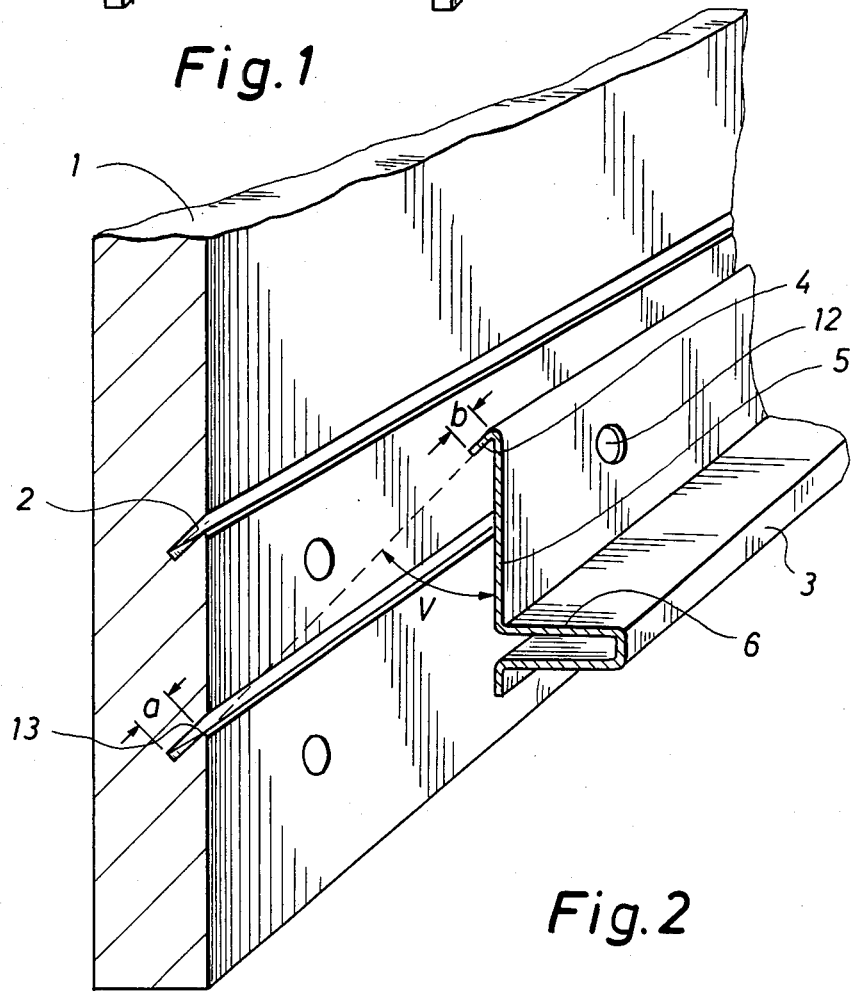
FIG. 2 is a perspective view of a frame sidepiece and a profiled rail member for the piece of furniture illustrated in FIG. 1.

In FIG. 2, which illustrates a fragment of one of the frame sidepieces and the profiled rail member 3, it is indicated, how a number of parallel, longitudinally extending grooves 2 is provided, into which a first flange 4 extending in the longitudinal direction of the rail member 3 may be inserted. When the first flange 4 has been inserted into one of the grooves 2, the web 5 of the rail member 3 abuts the frame sidepiece. The rail member 3 furthermore comprises a second flange 6 connected with the web of the rail member and extending outwardly from the frame sidepiece, so that it is capable of supporting a bottom portion. The first flange 4 forms an acute angle v in the range of 15°–75°, preferably 30°–60°, with the web 5. The grooves 2 formed in the frame sidepieces are correspondingly inclined. A number of bores 12 are provided in the web 5 of the rail member 3, so that said rail member can be screwed onto the frame sidepiece 1, after the first flange 4 has been inserted into the groove 2. To ensure that the lower surface of the flange 4 inserted into the groove abuts the lower surface of the groove completely, the depth a of the groove is greater than the length b of the flange 4 inserted into the groove of the rail member 3. Furthermore, the lower edge 13 of the groove 2 is bevelled.

Figure 3:
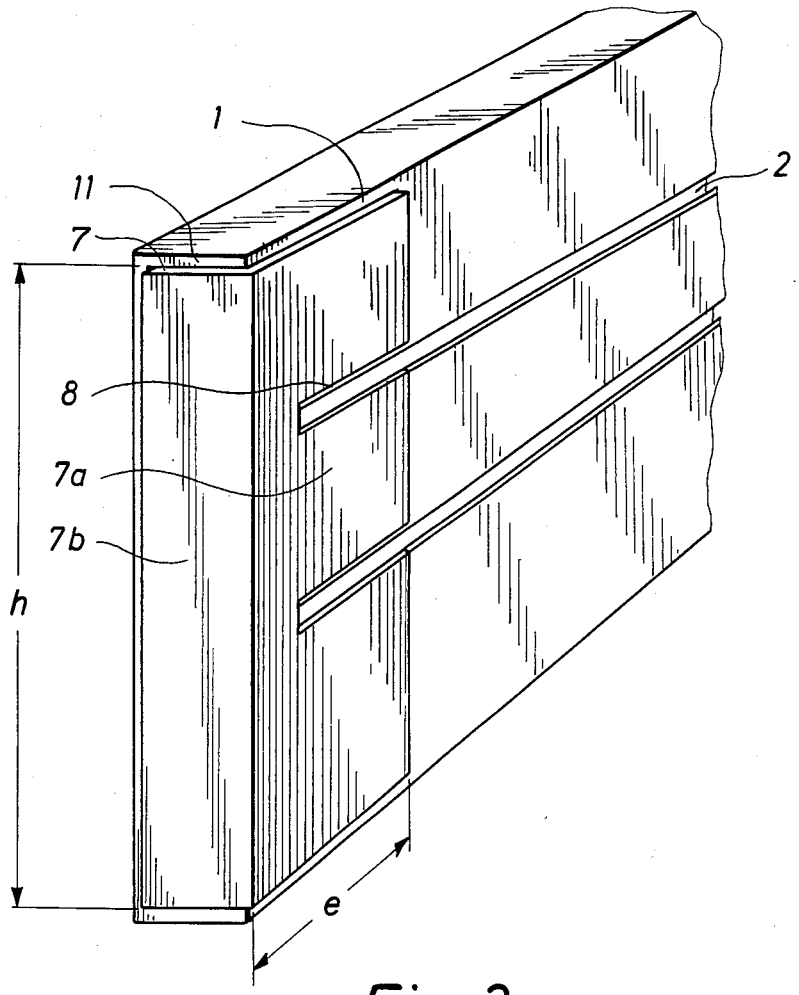
FIG. 3 is a perspective view of a frame sidepiece which at the end is provided with a strengthening mounting.

FIG. 3 illustrates a fragment of a frame sidepiece 1, in which a strengthening mounting 7 with two mounting parts *7a, 7b* is placed at each end. One of the mounting parts *7a* provided with slots 8 abuts the inner surface of the frame sidepiece, whereas the second mounting part *7b* abuts the edge 11 of the frame sidepiece. The mounting 7 is of substantially the same height h as the frame sidepiece 1, and the mounting part *7b* abutting the edge 11 of the frame side piece is of substantially the same width as said surface. The mounting part *7a* provided with slots is of a width I in the range of 10–50 mm, preferably 12–25 mm. The slots 8 in the mounting 7 are dimensioned and placed relative to the groove 2 in such a manner that the stress on the rail member at the rail member ends is transferred to the mounting 7.

Figure 4:
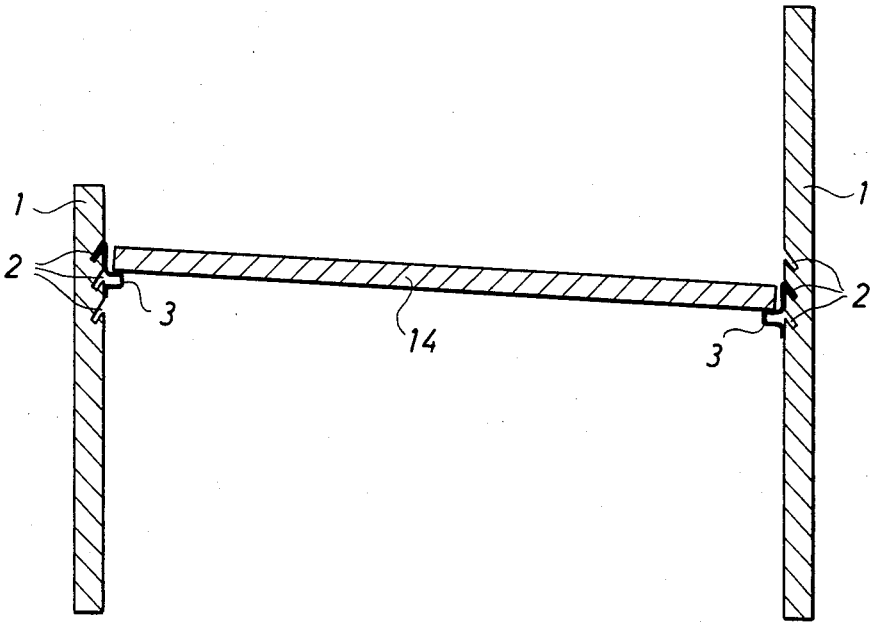
FIG. 4 is a vertical sectional view through another embodiment of the piece of furniture according to the invention, where the profiled rail members are placed at different levels, e.g. to support a seat for a piece of seating furniture.

FIG. 4 illustrates a second embodiment of the inventive piece of furniture, wherein the profiled rail members 3 on the two opposing frame sidepieces are located at different levels to obtain an inclination of the bottom portion 14. This embodiment is particularly suitable for seating furniture, as the total seating height and the seat inclination can be changed according to requirement.

The invention can be altered in many ways without thereby deviating from its idea; the strengthening mounting 7 need e.g. not be an angle plate, but may be a flat sheet corresponding to the mounting part *7b* being omitted, said flat sheet being located on the inner side of the frame side pieces 1.

I claim:

1. A piece of furniture, such as a bed or a chair, comprising: a substantially rectangular frame having two elogated frame sidepieces, a plurality of parallel, elongated grooves in surfaces of said sidepieces which face each other, two elongated profiled rail members, each rail member having a first flange inserted into a groove of the respective frame sidepiece, each rail member further comprising a web abutting the respective frame sidepiece, and also having a second flange extending outwardly from the respective frame sidepiece towards the other sidepiece, for supporting a furniture bottom portion, each first flange forming an acute angle in the range from 15° to 75° with its respective web, the grooves in the frame sidepieces forming a corresponding angle with the sidepiece surface, being free of an inner lining, and mounting means for strengthening the respective frame sidepiece, said mounting means being provided on and abutting the surface of the frame sidepieces at opposite ends thereof, said mounting means having spaced slots of approximately the same width as the grooves in the respective frame sidepiece, the first flange of the member extending into said slots and the web abutting the mounting means.

2. A piece of furniture as claimed in claim 1, wherein the range is from 30° to 60°.

3. A piece of furniture as claimed in claim 1, wherein the web has bores for screws for fastening the rail member onto the respective frame sidepiece.

4. A piece of furniture as claimed in claim 1, wherein the depth of the groove is greater than the width of the first flange, the groove having a bevelled edge at said corresponding angle.

5. A piece of furniture as claimed in claim 1, wherein each mounting means comprises two integral parts perpendicular to each other, one of said parts having said slots and the other abutting an edge of the respective frame sidepiece.

6. A piece of furniture as claimed in claim 5, wherein said mounting means is of substantially the same height as the frame sidepiece, and wherein said one mounting part is of a length in the range of 10–50 mm.

7. A piece of furniture according to claim 6, wherein said range is 12 to 25 mm.

8. A piece of furniture as claimed in claim 1, wherein the slots are dimensioned and positioned relative to the grooves such that stress on the rail member at its ends is transferred to the mounting means.

9. A piece of furniture as claimed in claim 1, wherein one rail member is positioned higher than the other for supporting a furniture bottom portion at an angle.

* * * * *

UNITED STATES PATENT AND TRADEMARK OFFICE

CERTIFICATE OF CORRECTION

PATENT NO. : 4,718,132

DATED : January 12, 1988

INVENTOR(S) : Kurt Wirland

It is certified that error appears in the above-identified patent and that said Letters Patent are hereby corrected as shown below:

Title page, Item [30] should be added as follows:

[30] Foreign Application Priority Data
June 13, 1985 [DK] Denmark.....2678/85

Signed and Sealed this

Thirty-first Day of May, 1988

*Attest:*

DONALD J. QUIGG

*Attesting Officer*

*Commissioner of Patents and Trademarks*